US009698575B2

(12) United States Patent
Stifel et al.

(10) Patent No.: US 9,698,575 B2
(45) Date of Patent: Jul. 4, 2017

(54) CORONA IGNITION DEVICE WITH GAS-TIGHT HF PLUG CONNECTOR

(71) Applicants: BorgWarner Ludwigsburg GmbH, Ludwigsburg (DE); Rosenberger Hochfrequenztechnik GmbH & Co. KG, Fridolfing (DE)

(72) Inventors: Timo Stifel, Korntal-Münchingen (DE); Martin Zebhauser, Laufen (DE); Wolfgang Lankes, Teisendorf (DE)

(73) Assignees: BorgWarner Ludwigsburg GmbH, Ludwigsburg (DE); Rosenberger Hochfrequenztechnik GmbH & Co. KG, Fridolfing (DE)

( * ) Notice: Subject to any disclaimer, the term of this patent is extended or adjusted under 35 U.S.C. 154(b) by 281 days.

(21) Appl. No.: 14/669,979

(22) Filed: Mar. 26, 2015

(65) Prior Publication Data

US 2015/0200522 A1 Jul. 16, 2015

Related U.S. Application Data

(63) Continuation of application No. PCT/EP2013/070790, filed on Oct. 7, 2013.

(30) Foreign Application Priority Data

Oct. 12, 2012 (DE) ..... 10 2012 109 762

(51) Int. Cl.
*F23Q 3/00* (2006.01)
*H01T 19/02* (2006.01)
(Continued)

(52) U.S. Cl.
CPC ..... *H01T 19/02* (2013.01); *H01T 13/08* (2013.01); *H01T 13/20* (2013.01); *H01T 13/44* (2013.01); *H01T 13/50* (2013.01); *F02P 23/04* (2013.01)

(58) Field of Classification Search
CPC ..... H01T 19/02
(Continued)

(56) References Cited

U.S. PATENT DOCUMENTS 2,575,140 A 11/1951 Smith
3,303,268 A 2/1967 Darnois
(Continued)

FOREIGN PATENT DOCUMENTS

DE 60 2005 004 362 T2 1/2009
EP 1 662 626 A1 5/2006
(Continued)

*Primary Examiner* — Stephen W Jackson
(74) *Attorney, Agent, or Firm* — Bose McKinney & Evans LLP

(57) ABSTRACT

This disclosure relates to a corona ignition device, comprising a center electrode, an insulator, into which the center electrode plugs, a coil, which is connected to the center electrode, and a housing, in which the coil is arranged. The housing is closed at one end by the insulator and at the other end carries an HF plug connector, which has an inner conductor connected to the coil and an outer conductor connected to the housing. In accordance with this disclosure, the HF plug connector contains a glass body, which seals an annular gap between the inner conductor and the outer conductor. This disclosure also relates to an HF plug connector suitable for such an HF ignition device.

10 Claims, 2 Drawing Sheets

(51) Int. Cl.

| | |
|---|---|
| ***H01T 13/08*** | (2006.01) |
| ***H01T 13/44*** | (2006.01) |
| ***H01T 13/50*** | (2006.01) |
| ***H01T 13/20*** | (2006.01) |
| *F02P 23/04* | (2006.01) |

(58) Field of Classification Search
USPC ..... 361/263
See application file for complete search history.

(56) References Cited

U.S. PATENT DOCUMENTS

| | | | | |
|---|---|---|---|---|
| 4,007,342 | A * | 2/1977 | Makino | F02P 7/025 123/146.5 A |
| 5,250,868 | A * | 10/1993 | Shirasu | H01L 41/0533 310/328 |
| 6,037,539 | A | 3/2000 | Kilgo et al. | |
| 7,182,077 | B2 * | 2/2007 | Ward | F02P 3/0435 123/634 |
| 8,653,693 | B2 * | 2/2014 | Aulisio | F02K 9/95 123/603 |
| 2012/0180743 | A1 | 7/2012 | Burrows et al. | |

FOREIGN PATENT DOCUMENTS

| | | | |
|---|---|---|---|
| EP | 2 456 027 | A1 | 5/2012 |
| WO | WO 2004/063560 | A1 | 7/2004 |

* cited by examiner

CORONA IGNITION DEVICE WITH GAS-TIGHT HF PLUG CONNECTOR

RELATED APPLICATIONS

This application is a continuation of PCT/EP2013/070790, filed Oct. 7, 2013, which claims priority to DE 10 2012 109 762.3, filed Oct. 12, 2012, both of which are incorporated herein by reference in their entireties.

BACKGROUND

The invention relates to a corona ignition device of the type generally known from EP 1 662 626 A1. Such corona ignition devices have, at their end remote from the combustion chamber, a plug connector with which they can be connected to a high-frequency generator or the on-board power supply system of a vehicle.

It is known from EP 1 662 626 A1 and WO 2004/063560 A1 how a fuel/air mixture in a combustion chamber of an internal combustion engine can be ignited by a corona discharge produced in the combustion chamber by a corona ignition device. The corona ignition device has a center electrode that is stuck in an insulator. The center electrode is thus electrically insulated with respect to a housing of the corona ignition device and the walls of the combustion chamber, which are at ground potential. The center electrode forms a capacitor together with the housing or the walls of the combustion chamber. Therein the housing and the walls of the combustion chamber act as a counter electrode of the capacitor.

This capacitor, together with a coil arranged in the housing, forms an electric oscillating circuit which is excited by a high-frequency voltage, which for example is produced with the aid of a transformer with center tap or another high-frequency generator. When the oscillating circuit is excited resonantly, there is a voltage step-up between the center electrode and the walls of the combustion chamber or the housing of the corona ignition device. This leads to the formation of a corona discharge in the combustion chamber. The corona discharge originates from an ignition tip on the center electrode.

Compared to conventional spark plugs, which ignite fuel/air mixtures by means of arc discharges, corona ignition devices have the advantage of a much lower burn-up of the electrodes or ignition tips. Corona ignition devices therefore have the potential of a much longer service life compared to conventional spark plugs.

SUMMARY

The present invention provides a way in which the service life of corona ignition devices can be improved.

An HF plug connector according to this disclosure makes it possible to close the housing pipe of a corona ignition device in a gas-tight manner. The service life of corona ignition devices can thus be increased. Specifically, causes of premature failure of corona ignition devices are often dielectric breakdowns in the interior of the corona ignition device. Since the housing pipe of the corona ignition device is closed by an HF plug connector according to this disclosure, an infiltration of air moisture into the housing can be prevented. This is important since air moisture reduces the threshold for dielectric breakdowns, and infiltrated moisture can therefore lead to a premature failure of a corona ignition device.

A plug connector according to this disclosure makes it possible to further reduce the risk of dielectric breakdowns since an increased gas pressure at 20° C., for example of 2 bar or more, preferably 5 bar or more, can be provided in the housing. The dielectric strength can thus be increased considerably even with dry air.

The risk of dielectric breakdowns can be reduced in particular by a gas insulation. To this end, the interior of the housing can be filled with an insulating gas, for example nitrogen, carbon dioxide and/or sulfur hexafluoride. E.g., a gas mixture containing at least 5% sulfur hexafluoride based on the total number of gas particles may be used as insulating gas.

The demands on a coaxial HF plug connector of a corona ignition device are high, since the engine operation entails a high thermal loading and also a high mechanical loading, in particular as a result of vibrations. By means of a glass body, which seals an annular gap between the inner conductor and the outer conductor, a gas tightness of $10^{-7}$ mbar·1/s and better can be achieved nevertheless.

The glass body is provided as a glass melt, which surrounds the inner conductor. When liquid glass is brought into contact with the inner conductor and the outer conductor, an integral bond is produced between the glass and the inner conductor on the one hand and between the glass and the outer conductor on the other hand.

The glass body may form a compression glass seal. A compression glass seal utilizes the fact that a metal body, in this case the outer conductor, has a higher coefficient of thermal expansion compared to the glass body surrounded by it. To produce a compression glass seal, the outer conductor is heated and the annular gap between the outer conductor and the inner conductor is closed by liquid glass. Upon cooling, the glass body hardens and contracts. Due to its higher coefficient of thermal expansion, the outer conductor contacts more strongly than the glass body, and therefore the glass body is pressed with a considerable pressure against the inner conductor. An outstanding seal both between the glass body and the inner conductor and also between the glass body and the surrounding outer conductor can thus be achieved with a compression glass seal. The inner conductor may have a smaller coefficient of thermal expansion than the glass body. The inner conductor then specifically contracts less strongly during cooling than the glass body surrounding it. The force with which the glass body is pressed against the inner conductor is then greater, and the seal is also better accordingly.

For example, the outer conductor can be made of steel or an iron/nickel alloy, preferably having a coefficient of thermal expansion of at least $80 \cdot 10^{-7}$ per Kelvin at 20° C., for example in the range from 80 to $180 \cdot 10^{-7}$ per Kelvin at 20° C. Glasses having a coefficient of thermal expansion of, for example, 50 to $100 \cdot 10^{-7}$ per Kelvin can then be used for the glass body. Glasses of this type are commercially available. For example, quartz glass is suitable. The inner conductor can be formed from an invar alloy for example. A suitable alloy is commercially obtainable for example under the trademark KOVAR® (ASTM F-15).

The outer conductor of the plug connector may be integrally bonded to a housing pipe of the corona ignition device, for example by welding.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
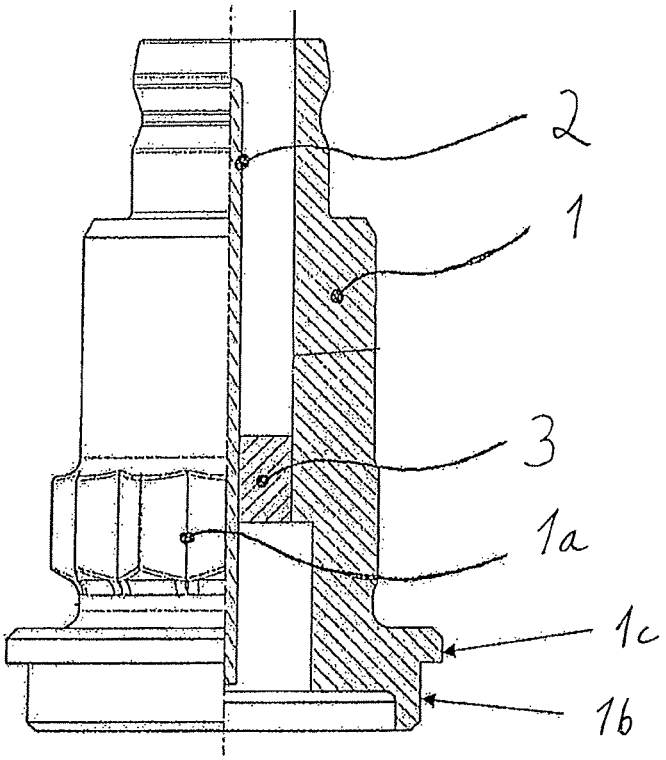
FIG. 1 shows an HF plug connector in a partly sectional view.

The HF plug connector illustrated in FIG. 1 comprises a metal housing 1, which forms the outer conductor of the coaxial plug connector, a metal inner conductor 2, and a glass body 3, which seals an annular gap between the inner conductor 2 and the outer conductor 1. The glass body 3 can form a compression glass seal for the inner conductor 2. In the embodiment shown, the glass body 3 is an insulating support for the inner conductor 2, such that it is possible to dispense with further components.

The annular gap between the outer conductor 1 and inner conductor 2 may be 2 mm wide or even wider. The diameter of the inner conductor can be smaller than the width of the annular gap, for example 1 to 1.5 mm. With these dimensions, a gas-tight compression glass seal can be effectively implemented and connected to a wide annular gap sufficient for the electrical insulation of the inner conductor 2 with respect to the outer conductor 1.

The high-frequency plug connector can be used anywhere an HF component is to be detachably electrically connected to a high-frequency line. The HF plug connector is particularly well suited for a corona ignition device with which a fuel/air mixture in a combustion chamber of an internal combustion engine is ignited by means of a corona discharge.

The outer conductor 1 of the illustrated HF plug connector can have a portion 1*a*, which has an outer surface contoured for engagement with a spanner. For example, the portion 1*a* may have a hexagon profile or bi-hexagon profile. If the HF plug connector is installed on a housing of a corona ignition device, the functional area of the contoured portion 1*a* can be used to screw the corona ignition device into the threaded block of an engine. The outer conductor may have further functional areas, for example for engagement with a matching counter plug connector.

In order to facilitate the fastening of the HF plug connector to a housing pipe, said connector has a cylindrical end portion 1*b*, which starts from a peripheral shoulder 1*c*. By means of this end portion 1*b*, the HF plug connector can be plugged into a housing pipe. The peripheral shoulder 1*c* is formed by a flange, which then rests on the end face of the housing pipe. The HF plug connector can then be fastened to a housing pipe, for example by welding, for example laser welding or magnetic crimping.

Figure 2:
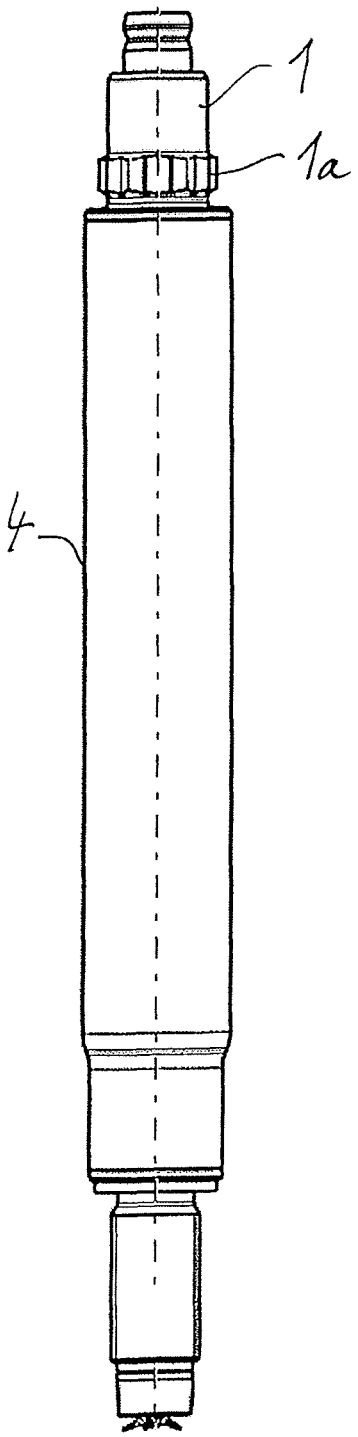
FIG. 2 shows a corona ignition device with such an HF plug connector.
Figure 3:
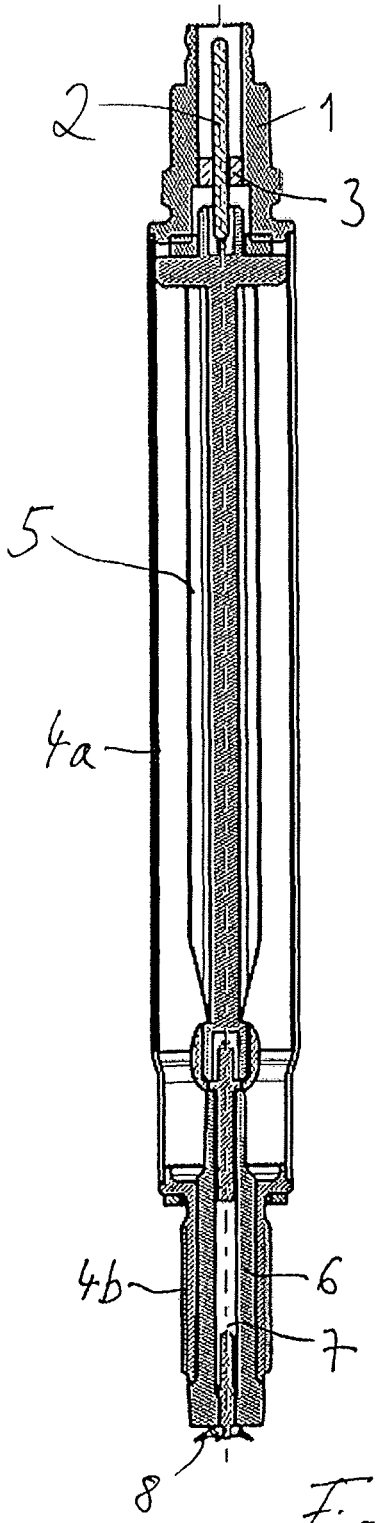
FIG. 3 shows a longitudinal section of FIG. 2.

FIGS. 2 and 3 show a corona ignition device with the HF plug connector illustrated in FIG. 1. The corona ignition device has a housing 4, which is connected in a gas-tight manner to the outer conductor 1 of the HF plug connector, for example by welding. In the illustrated illustrative embodiment, the housing 4 consists of a plurality of parts, specifically a housing pipe 4*a*, in which a coil 5 is arranged, and a housing head 4*b*, which surrounds an insulator 6. The coil 5 is wound on a coil former, which, at its end, may carry a socket into which the inner conductor 2 is plugged. The inner conductor 2 may thus be connected to the coil 5.

The housing 4*b* in the illustrated embodiment has an outer thread for screwing into an engine block. An outer thread is not necessary however, since the corona ignition device can also be fastened to the engine block in any other way.

A center electrode 7 passes through the insulator 6 to one or more ignition tips 8. The housing head 4*b*, the center electrode 7 and the insulator 6 form a capacitor. This capacitor is connected in series with the coil 5 and forms an electric oscillating circuit therewith. By exciting this oscillating circuit, a corona discharge can be generated starting from the ignition tips 8.

The housing 4 of the corona ignition discharge is closed in a gas-tight manner at its end on the side of the combustion chamber by the insulator 6 and at its end remote from the combustion chamber by the HF plug connector. In order to reduce the risk of dielectric breakdowns in the interior of the housing, the gas pressure in the interior of the housing is increased with respect to the atmospheric pressure, for example to a value of more than two bar. Values from 5 bar to 30 bar are well suited.

The gas-tight closure of the housing 4 of the corona ignition device enables a gas insulation. A gas insulation reduces not only the risk of dielectric breakdowns, but also reduces losses of the oscillating circuit in the conductive housing 4 of the corona ignition device.

The gas insulation in the interior of the corona ignition device can be achieved for example by nitrogen, dry air, sulfur hexafluoride and/or carbon dioxide. Insulating gases such as nitrogen, sulfur hexafluoride and carbon dioxide are particularly well suited. In particular, gas mixtures that contain sulfur hexafluoride, for example 5 based on the total number of gas molecules) or more, enable an outstanding gas insulation.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE NUMBERS

1 outer conductor of the HF plug connector
1*a* functional area of the outer conductor
1*b* cylindrical end portion of the outer conductor
1*c* peripheral shoulder of the outer conductor
2 inner conductor of the HF plug connector
3 glass body of the HF plug connector
4 housing of the corona ignition device
4*a* housing pipe
4*b* housing head
5 coil
6 insulator
7 center electrode
8 ignition tip

What is claimed is:

1. A corona ignition device, comprising:

a center electrode;

an insulator surrounding the center electrode;

a coil connected to the center electrode;

a housing in which the coil is arranged, the housing being closed at one end by the insulator and at the other end carrying an HF plug connector;

the HF plug connector having an inner conductor made of an Invar alloy and connected to the coil, and the HF plug connector having an outer conductor made of steel and connected to the housing; and wherein the HF plug connector comprises a glass body which seals an annular gap between the inner conductor and the outer conductor, wherein the glass body forms a compression glass seal.

2. The corona ignition device according to claim 1, wherein the interior of the housing is filled with an insulating gas.

3. The corona ignition device according to claim 2, wherein the insulating gas contains sulfur hexafluoride.

4. The corona ignition device according to claim 1, wherein the gas pressure in the housing is higher than ambient atmospheric pressure.

5. The corona ignition device according to claim 1, wherein the inner conductor has a diameter of at most two millimeters.

6. The corona ignition device according to claim 1, wherein a portion of the housing is formed by a housing pipe, into which a cylindrical end portion of the outer conductor protrudes.

7. The corona ignition device according to claim 6, wherein the plug connector has a peripheral shoulder with which it sits on an end face of the housing pipe.

8. The corona ignition device according to claim 6, wherein the plug connector has a portion which has an outer surface contoured for engagement with a spanner.

9. A gas-tight high-frequency plug connector, comprising:

an inner conductor made of an Invar alloy, an outer conductor made of steel, and a glass body which seals an annular gap between the inner conductor and the outer conductor, wherein the glass body forms a compression glass seal.

10. The corona ignition device according to claim 9, wherein the inner conductor has a diameter of at most two millimeters.

* * * * *